US005465970A

United States Patent [19]

Adams et al.

[11] Patent Number: 5,465,970

[45] Date of Patent: Nov. 14, 1995

[54] METAL WOOD GOLF CLUB HEAD

[75] Inventors: Byron H. Adams, Dallas, Tex.; Chia W. Lee, Kaohsiung, Taiwan

[73] Assignee: Adams Golf, Inc., Richardson, Tex.

[21] Appl. No.: 336,660

[22] Filed: Nov. 4, 1994

[51] Int. Cl.[6] ..... A63B 53/04

[52] U.S. Cl. ..... 273/169; 273/167 H

[58] Field of Search ..... 273/167 R, 167 D, 273/167 E, 167 H, 167 F, 169, 167 A, 174, 167 J, 194 R, 193 R, 77 R, 77 A, 167 G, 80 C, DIG.8; D21/214–220

[56] References Cited

U.S. PATENT DOCUMENTS

| | | | |
|---|---|---|---|
| D. 229,431 | 11/1973 | Baker | 273/167 G |
| 3,416,798 | 12/1968 | Pennington | 273/168 |
| 3,980,301 | 9/1976 | Smith | 273/167 G |
| 4,147,349 | 4/1979 | Jeghers | 273/77 A |
| 4,214,754 | 7/1980 | Zebelean | 273/167 H |
| 4,426,083 | 1/1984 | Dishner | 273/164.1 |
| 4,432,549 | 2/1984 | Zebelean | 273/167 H |
| 4,438,931 | 3/1984 | Motomiya | 273/167 H |
| 5,271,620 | 12/1993 | Moriguchi | 273/167 H |

FOREIGN PATENT DOCUMENTS

| | | | |
|---|---|---|---|
| WO8801525 | 3/1988 | WIPO | 273/167 F |

*Primary Examiner*—Sebastiano Passaniti
*Attorney, Agent, or Firm*—Aquilino & Welsh

[57] ABSTRACT

A metal wood golf club head having an upright trapezoidal geometry with an improved weight distribution and aerodynamic configuration wherein the bottom surface area is significantly larger than the top surface area of the club head.

6 Claims, 1 Drawing Sheet

26
10
16

14
24
12
22

28
24
30
22
26

20
22
18

24
18
20
30
28

METAL WOOD GOLF CLUB HEAD

BACKGROUND AND SUMMARY OF THE INVENTION

The present invention relates to a metal wood type golf club head and, in particular, to a metal wood head having an improved aerodynamic design and weight distribution.

Traditionally, wood and metal wood type golf club heads are formed with a ball striking face, upper surface, bottom sole, heel and toe and rear surface areas, wherein the upper surface is tear-drop shaped and formed in a smooth aerodynamic configuration with gently rolling surfaces. The upper surface is traditionally larger than the bottom sole so that the club face configuration is formed generally in the shape of an inverted trapezoid.

With the advent of modern casting techniques, the size and shape of these type golf club heads has varied considerably. Many golf club heads known in the prior art and available in the market place are provided with aerodynamic surfaces which control the direction and velocity of air flow across the club head as it is being swung to increase club head speed by reducing drag. Club heads are also made in a variety of sizes and configurations in order to redistribute the weight either upwardly or downwardly or in a heel toe direction to satisfy the requirement of particular golfers to enable them to maximize the energy transfer to a golf ball when it is struck. However, many golf clubs are made with a higher center of gravity because of the weight distribution of the club head. This higher center of gravity requires more loft to affect the optimum launch angle that a golf ball needs to achieve maximum distance. The more loft that is used, the more spin is put on the ball, resulting in ineffective ball flight. A golf ball is moved by energy which translates into spin and velocity. A lower center of gravity needs less loft (face angle) to achieve optimum launch angle. The resultant ball flight is affected more by velocity than spin. The ball travels at a forward angle with more carry and more roll on the ground. Effective in calm conditions, this is particularly effective in windy conditions, since the ball is kept lower to the ground.

The present invention relates to a golf club head having a unique aerodynamic shape and weight configuration which maximizes energy transfer for a given effort by a golfer when hitting a golf ball. With the present invention, the golf club head has an upright trapezoidal geometry wherein the preponderance of weight is formed on the bottom of the golf club head, whereby the bottom surface or sole plate of the club head is significantly larger than the top surface thereof and the side walls are angled upwardly and inwardly creating the trapezoidal shape. This configuration creates a lower center of gravity, which allows an optimum launch angle at a lower loft without creating too much spin on the ball, thereby negating the ballooning effect, or too little loft, which results in insufficient carry of the ball during flight.

The sides of the club head at the heel and toe and rear surface are angled upwardly and inwardly to provide an aerodynamic configuration whereby there is less resistance at the top of the club head because of a smaller upper surface which results in reduced drag at the rear of the club head when it is being swung. The club head also includes an inside wall directly behind the ball striking face which is formed at an angle, the lower portion of the ball striking face being thicker and tapering to a less thick configuration toward the upper surface. This also aids in lowering the center of gravity to launch the ball with maximum velocity and the correct amount of spin. Additionally, the thickened reinforced ball striking face minimizes club face deflection when the golf ball is impacted.

Among the objects of the present invention are a provision of an improved aerodynamically trapezoidal shaped metal wood type golf club head with improved weight distribution and having a lower center of gravity to provide an optimum launch angle and spin rate to produce maximum carry and roll to a golf ball. Another object of the present invention is to provide a metal wood type golf club head having a bottom surface with a larger area than the top surface of the club head to redistribute the weight of the bottom of the club head. Still another object of the present invention is the provision of a metal wood type golf club head with an improved weighting system to locate the weight of the club head at the bottom. These and other objects will become apparent with reference to the following drawings and specification.

DESCRIPTION OF THE PREFERRED EMBODIMENTS

Figures 1, 2, 3, 4, 5:
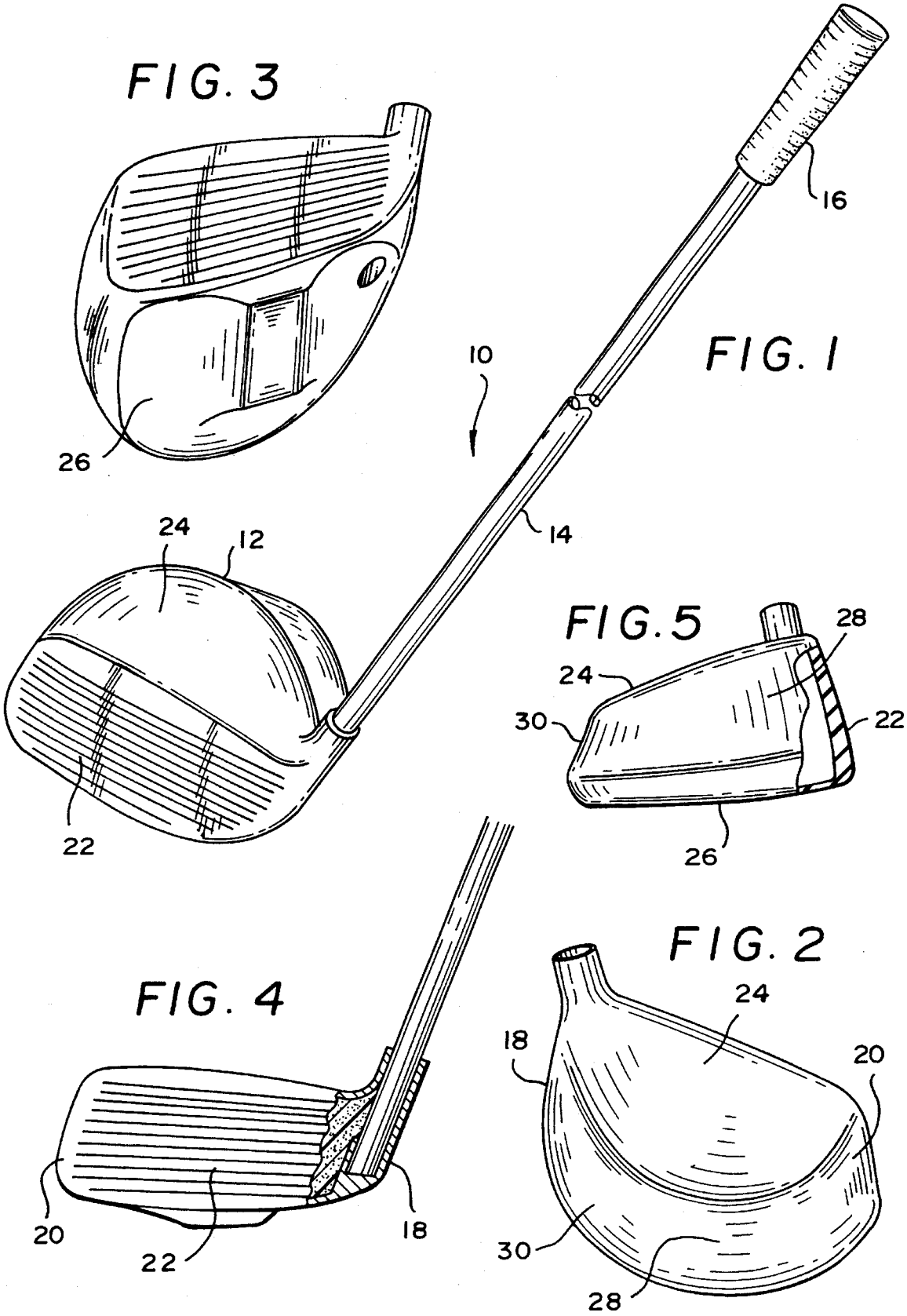
FIG. 1 is a perspective view of a golf club in accordance with the present invention.
FIG. 2 is a top perspective view of a golf club head in accordance with the present invention.
FIG. 3 is a front elevational view, partly in section, of the golf club of the present invention.
FIG. 4 is a bottom perspective view of a golf club head in accordance with the present invention.
FIG. 5 is an end elevational view, partly in section, of a golf club head in accordance with the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Referring to the drawings, golf club 10 of the present invention includes a golf club head 12, a shaft 14 and a grip 16. The overall geometry of the club head is defined as an upright trapezoidal shape with a layer base at the bottom and smaller base at the top. The golf club head is formed with a metal shell 17 having a heel 18, toe 20, ball striking face 22, upper surface 24 and lower surface 26. As can be seen best with respect to FIG. 2, the upper surface 24 and the lower surface 26 are connected by a side wall 28 extending around the club head between the toe 20 and the heel 28 forming a rear surface 30. As seen, the bottom surface 26 area is larger than the top surface 24 area whereby the side wall 28 extends upwardly and inwardly in a bottom to top direction. Preferably, the metal shell has approximately the same thickness and weight per given area at the top surface and the bottom surface. Therefore, the club head 12 has a greater weight distribution at the bottom surface 26 because of its greater size and a lesser weight distribution at the upper surface 24 because of its lesser size.

The frontal portion of the metallic shell which forms the club head 12 has a wall thickness at the ball striking face 22 which is thicker toward the bottom 26 of the club head 12 and which tapers upwardly, becoming gradually thinner as it approaches the top surface 24 of the club head. The ball striking face dimensions, as well as the overall configuration of the larger bottom 26 and smaller top surface 24 distribute a larger portion of the overall weight of the club head toward the bottom thereof. This has the effect of lowering the center of gravity, which in turn allows the club head to have less loft to achieve the optimum launch angle. Less loft in turn produces less spin, and therefore a ball struck by the club head is using optimum velocity, creating more distance from equal to greater carry at a lower angle. This is particularly effective in windy conditions.

As can be seen from the drawings, the overall surface area of the top surface 24 is approximately 60% of the total surface area of the bottom surface 26. However, it will be appreciated that the top surface may be as little as 35% or as much as 90% of the total area of the total surface area of the bottom surface 26 in keeping with the scope and spirit of the present invention.

While various preferred embodiments have been shown and described, it will be understood that there is no intent to limit the invention by such disclosure, but rather, is intended to cover all modifications and alternate constructions falling within the spirit and scope of the invention as defined in the appended claims.

We claim:

1. A metal wood golf club head comprising a metal shell having a hosel, ball striking face, heel, toe, upper surface, bottom surface, side and rear walls; said club head characterized by an upright trapezoidal geometry wherein said bottom surface has a greater area than said top surface and said side and rear walls are angled upwardly and inwardly from an outer periphery of said bottom surface to an outer periphery of said top surface.

2. The golf club head of claim 1 wherein said upper surface area is within a range of 35% to 90% of the bottom surface area.

3. The golf club head of claim 1 wherein said upper surface area is approximately 60% of the bottom surface area.

4. The golf club head of claim 1 wherein said metal shell includes a wall forming said ball striking face; said wall being thicker adjacent the bottom surface of said club head.

5. The golf club head of claim 4 wherein said wall becomes progressively thinner from the bottom surface of the club head toward the top surface thereof.

6. The golf club head of claim 1 wherein said metal shell has approximately the same thickness and weight per given area at said upper surface and said bottom surface; said club head having a greater weight distribution at said bottom surface and a lesser weight distribution at said upper surface.

* * * * *